US007160006B1

(12) United States Patent
Horner et al.

(10) Patent No.: US 7,160,006 B1
(45) Date of Patent: Jan. 9, 2007

(54) CLIP FOR LIGHT FIXTURE AND A LIGHT FIXTURE APPARATUS

(75) Inventors: Don Horner, Monroeville, NJ (US); Steve Brown, Highland Park, IL (US)

(73) Assignee: A.L.P. Lighting & Ceiling Products, Inc., Niles, IL (US)

( * ) Notice: Subject to any disclaimer, the term of this patent is extended or adjusted under 35 U.S.C. 154(b) by 215 days.

(21) Appl. No.: 10/929,043

(22) Filed: Aug. 27, 2004

(51) Int. Cl.
*F21V 17/10* (2006.01)
*A44B 21/00* (2006.01)

(52) U.S. Cl. ..... 362/374; 362/433; 24/561

(58) Field of Classification Search ..... 362/374, 362/375, 223, 310, 433, 457; 24/563, 545, 24/546, 555, 556, 561, 562
See application file for complete search history.

(56) References Cited

U.S. PATENT DOCUMENTS 3,013,654 A * 12/1961 Hoff ..... 206/343
3,159,352 A * 12/1964 Vick et al. ..... 362/222
3,375,773 A * 4/1968 Wotowiec et al. ..... 454/248
3,384,935 A * 5/1968 Salvador ..... 24/557
4,580,200 A * 4/1986 Hess et al. ..... 362/223
5,171,085 A * 12/1992 Jaksich ..... 362/147
5,865,532 A * 2/1999 Bonazzi ..... 362/374
6,601,976 B1 * 8/2003 Rhee ..... 362/374

* cited by examiner

*Primary Examiner*—Alan Cariaso
(74) *Attorney, Agent, or Firm*—Adam K Sacharoff; Much Shelist

(57) ABSTRACT

A clip to be installed on a diffuser such that a lip defined by the rim of the diffuser is positioned in a cavity of the clip, with two arms defined by the clip capturing the rim of the diffuser and a leg defined by the clip extending into the hollow center of the diffuser. The diffuser may include knobs positioned on either side of the clip to prevent the same from sliding. The leg of the clip is then placed in an inverted channel defined by the lighting fixture such that the clip secures the diffuser thereto.

4 Claims, 5 Drawing Sheets

CLIP FOR LIGHT FIXTURE AND A LIGHT FIXTURE APPARATUS

FIELD OF THE INVENTION

The present invention relates to light fixtures and more particularly to clips used in a fluorescent tubes light fixture.

BACKGROUND OF THE INVENTION

In the construction of lighting fixtures and particularly fluorescent lighting fixtures adapted to mount electrical components for operating fluorescent light tubes from it has been common practice to form such fixtures with a housing having a diffuser cover mounted centrally thereon. It has been common to mount such diffusers from the fixture housing in a manner which will provide easily mounting and dismounting thereof.

In U.S. Pat. No. 6,601,976 the diffuser is mounted to side rails defined on or mounted to the housing. In U.S. Pat. No. 3,159,352 the diffuser includes inwardly projecting flanges that overlay on outwardly projecting flanges defined on the housing. The '352 patent includes mounting end caps that secure the diffuser and housing together. In U.S. Pat. No. 5,171,085 the diffuser includes inwardly curved grooves to hook onto a screw fastened to the housing. U.S. Pat. No. 4,580,200 defines an elongated C-shaped clip that secures the diffuser to the housing.

To make the mounting and dismounting more easily, the industry has deviated from elongated clips and more complicated methods and is relaying heavily on small metal fasteners. The present invention builds upon the prior art and the current industry standard, and has developed an improved clip for mounting a diffuser to a lighting housing.

SUMMARY OF THE INVENTION

In accordance with the present invention, a clip is provided for attaching a diffuser to a lighting fixture. The clip includes a body portion that has a first arm and a second arm, which extending away from the body portion. The first arm has an intermediate curved segment that corresponds to an intermediate curved segment on the second arm. The intermediate curved segments defined on the first and second arms may be offset and inverted with respect to each other. A rounded region is formed on the main body portion to define a cavity between the main body portion and the first and second arms. The clip may also include a channel between the first and second arms that is in communication with the cavity. A leg portion extends away from the rounded region. The leg portion may also include a rim defined on an end of the leg portion.

The clip is installed on a diffuser such that a lip defined by the rim of the diffuser is positioned in the cavity of the clip, with the two arms capturing the rim of the diffuser and the leg of the clip extending into the hollow center of the diffuser. The diffuser may include knobs positioned on either side of the clip to prevent the same from sliding along the rim of the diffuser. The leg of the clip is then placed in an inverted channel defined by the lighting fixture such that the clip secures the diffuser thereto in a manner that allows the diffuser to be easily mounted to and dismounted to a lighting fixture.

Numerous other advantages and features of the invention will become readily apparent from the following detailed description of the invention and the embodiments thereof, from the claims, and from the accompanying drawings.

BRIEF DESCRIPTION OF THE DRAWINGS

A fuller understanding of the foregoing may be had by reference to the accompanying drawings, wherein.

DETAILED DESCRIPTION OF THE EMBODIMENTS

Figure 1:
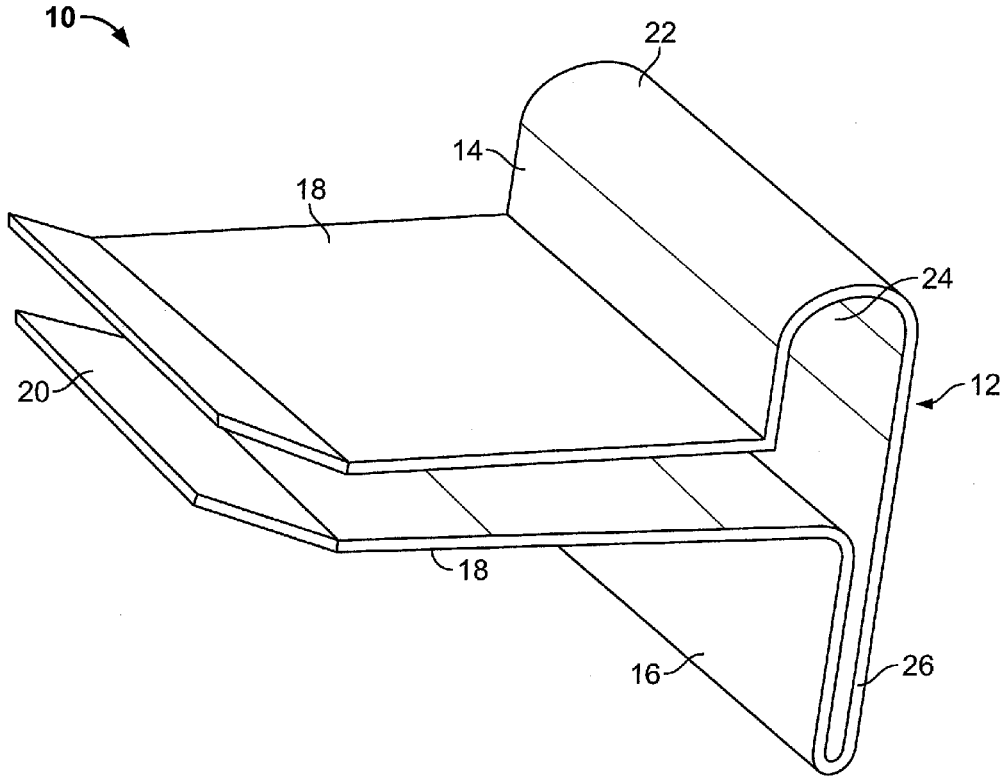
FIG. 1 (Prior Art)
FIG. 1 is a perspective view of a prior art fastener used to mount a diffuser to a housing of a lighting fixture.

While the invention is susceptible to embodiments in many different forms, there are shown in the drawings and will be described herein, in detail, the preferred embodiments of the present invention. It should be understood, however, that the present disclosure is to be considered an exemplification of the principles of the invention and is not intended to limit the spirit or scope of the invention and/or claims of the embodiments illustrated.

FIG. 1 illustrates a prior art fastener, generally referred to as 10. The prior art fastener 10 is typically a single piece of extruded metal bent and formed into its present shape. The prior art fastener 10 once formed has first and second members 14 and 16 extending outwardly from a main body portion 12 forming arms 18. The arms 18 are spaced apart equally to define a channel 20 therebetween. The body portion 12 also includes a rounded region 22 formed by curving the first member 14 away from the arms 18 towards the body portion 12, which defines a cavity 24 therein. The second member 16 also extends away from the first member 14 to form a leg portion 26. The cavity 24 and the channel 20 are in communication with each other. The use of the fastener is further explained below in the explanation of the present invention.

Figure 2:
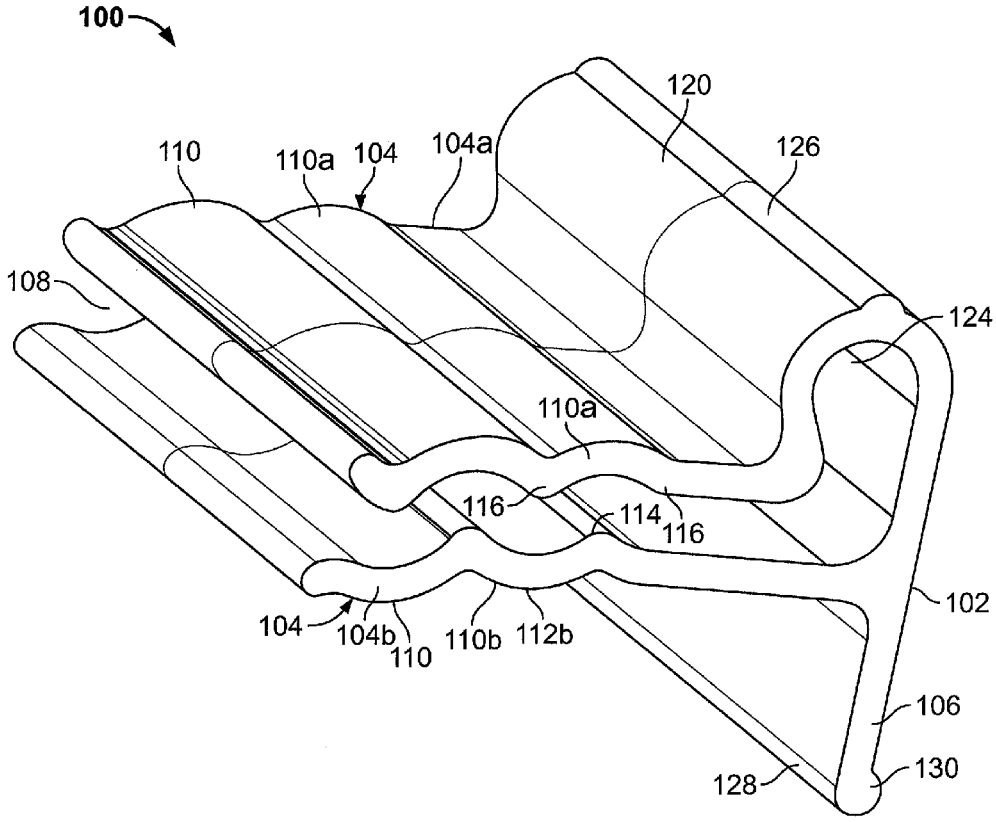
FIG. 2 is a perspective view of a clip used to mount a diffuser to a housing of a lighting fixture in accordance with the present invention.

Referring now to the present invention, as illustrated in FIG. 2, a clip is shown and generally referenced to as numeral 100. The clip 100 includes a main body portion 102, a pair of arms 104, and a leg portion 106. The arms 104 (referred also as a first arm 104*a* and a second arm 104*b*) are spaced apart from each other to define a channel 108 therebetween. In addition, each arm 104 has a portion that is serpentine or has at least one curved segment 110. Preferably, the second arm 104*b* has a curved segment 110*b* that corresponds to an offset and flipped curved segment 110*a* on the first arm 104*a*. Having offset and flipped curved segments will cause one of the curved segments to have an endpoint 114 that lies between the two endpoints 116 defined by its corresponding curved segment.

The main body portion 102 of the clip 100 also includes a rounded region 120 formed by curving the first arm 104*a* away from the second arm 104*b* and then towards the main body portion 102, which further defines a cavity 124 therein. The cavity 124 and the channel 108 are in communication with each other. The apex of the rounded region 120 also includes a rib 126.

As mentioned above, the main body portion 102 also includes a leg portion 106, which extends away from the rounded region 120. The end 128 of the leg portion 106 also includes a rim 130.

Figure 3A:
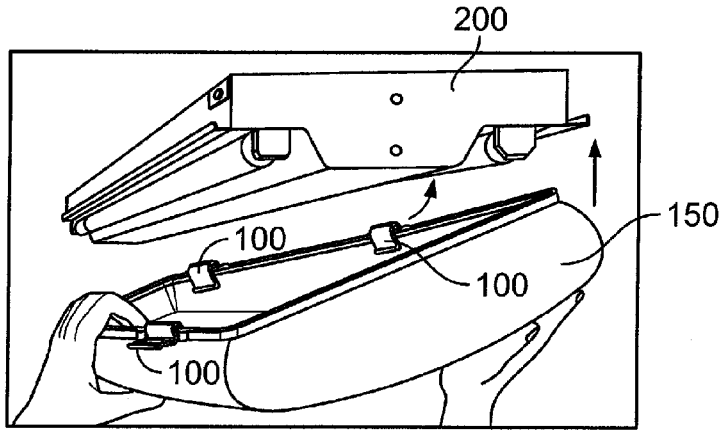
FIGS. 3*a* through 3*c* are perspective views of mounting a diffuser to a lighting fixture uses the clips of FIG. 2.
Figure 3B:
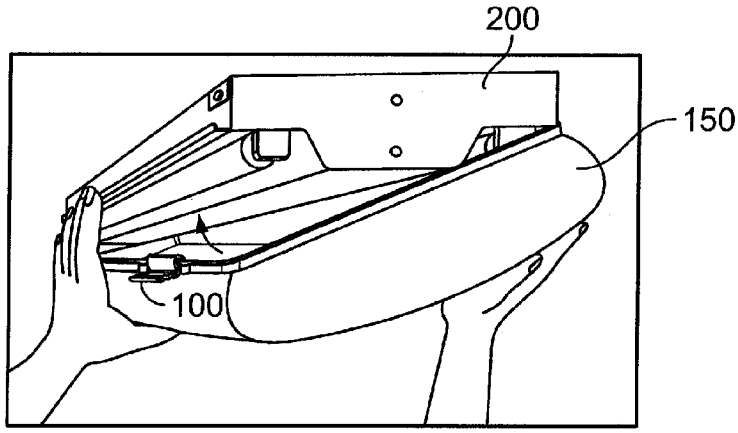
Figure 3C:
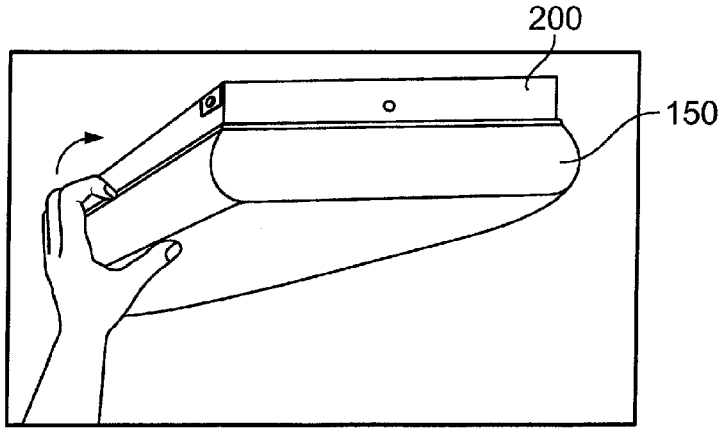
Figure 4A:
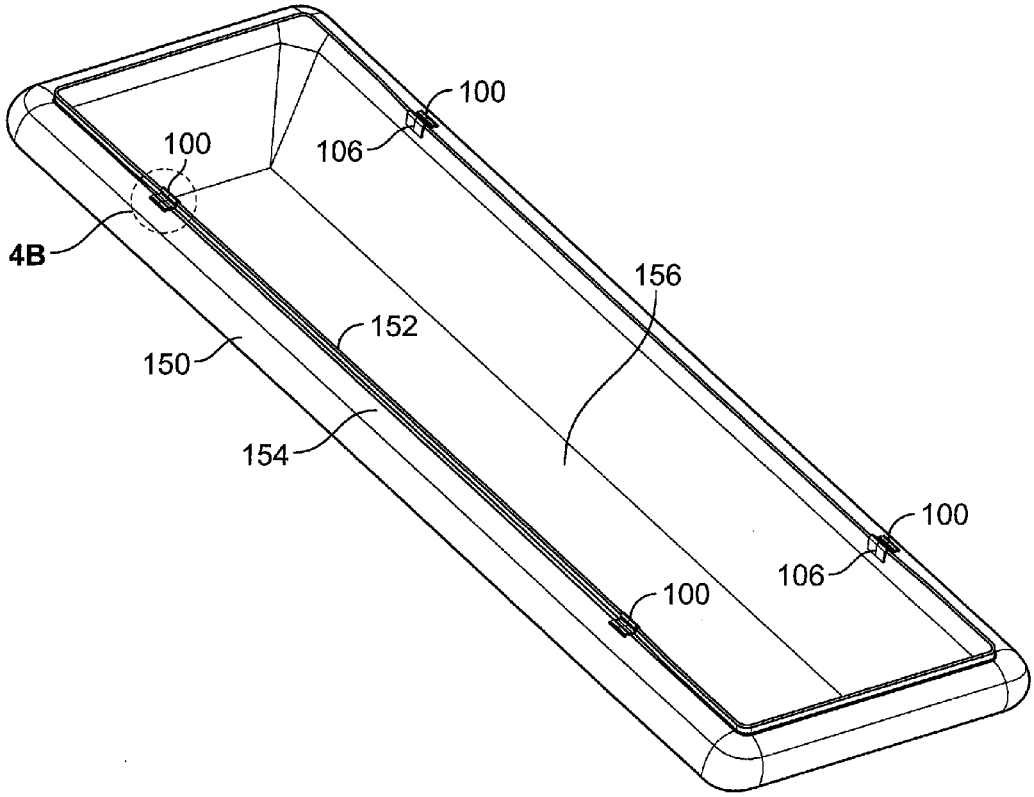
FIG. 4*a* is a perspective view of an improved diffuser which utilizes the clips of FIG. 2.
Figure 4B:
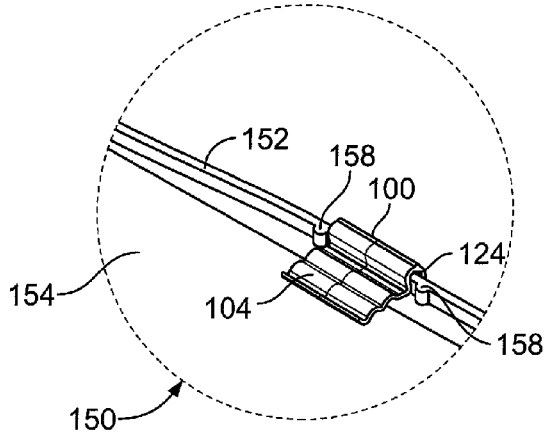
FIG. 4*b* is an enlarged perspective view of area M illustrating the knobs on the improved diffuser.

Referring now also to FIGS. 3*a* through 3*c*, when a lighting fixture 200 is secured to a wall or ceiling the diffuser 150 may be attached thereto, with the clips 100 (FIGS. 3*a* through 3*c*). Assembly is accomplished by first securing the clips 100 to the diffuser 150 (illustrated in FIGS. 4*a* and 4*b*). The diffuser 150 has a lip 152 that extends away from a rim 154 defined around the entire circumference of the diffuser 150. To secure the clips 100 to the diffuser 200, the arms 104 are spread apart and the clip 100 is slid onto the rim 154 of the diffuser. The clip 100 is positioned such that the cavity 124 of the clip 100 receives the lip 152 of the diffuser 150 (FIGS. 4*a* and 4*b*). In this position, the leg 106 of the clip 100 is also extending into the hollowed center 156 of the diffuser 150. Multiple clips 100 may be used.

To prevent the clips 100 from sliding or moving after attaching them to the diffuser 150, the diffuser 150 may include a clip retention assembly in the form of a pair of knobs 158 extending from the lip 152. The knobs 158 are spaced such that each knob of the pair of knobs rests on either side of the clip 100 preventing the clips from moving. If the clips move or slide towards each other the balance or weight of the diffuser may no longer be supported by the lighting fixture.

Figure 5:
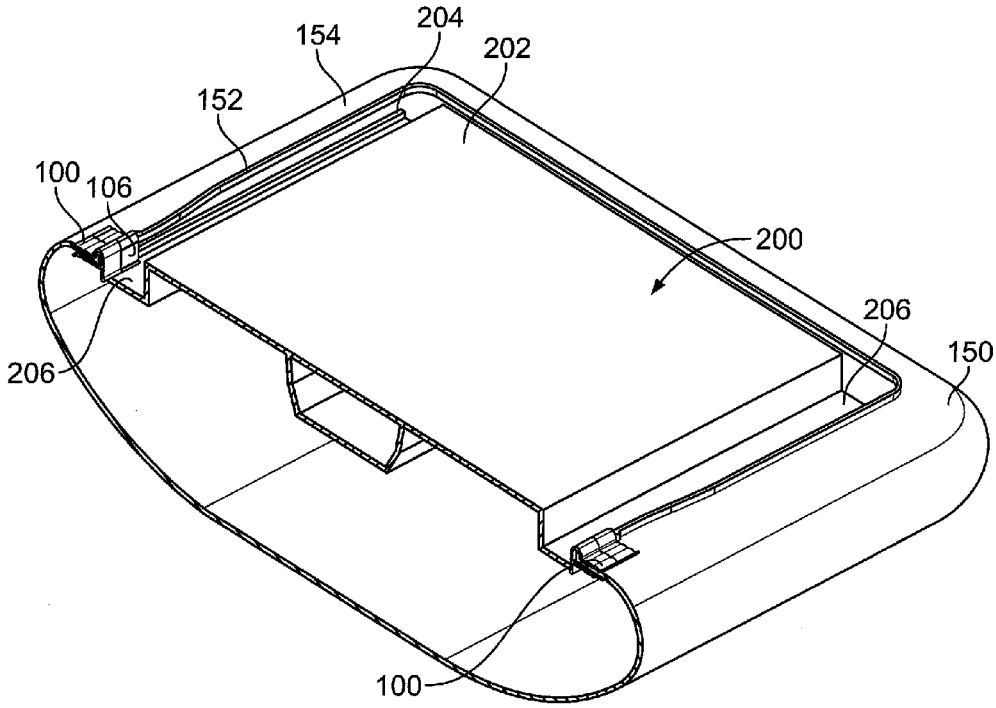
FIG. 5 is a sectional perspective view of the improved diffuser and clips of the present invention as attached to a lighting fixture.

Once the clips 100 are secured on the diffuser 150, the user hooks the clips on one side of the diffuser 150 over the frame 202 of the lighting fixture 200 (FIG. 3*b*). The other side of the diffuser 150 is then lifted up to attach the clips on the other side (FIG. 3*c*). As illustrated in FIG. 5, the lighting fixture 200 includes a frame 202 that includes flanges 204 that extend to form an inverted channel 206 between the flange and the frame 202. The inversion of the channel is taken with respect to the leg 106 of the clip 100, meaning that the leg 106 of each clip 100 is placed into the channel such that the clip 100 secures the diffuser to the lighting fixture.

The rib 126 on the apex of the rounded region 120 is included to increase the leverage a user has when installing or removing the clip. The user may grip the rib 126 to help pry the arms apart. The same may be said of the rim 130 defined on the end 128 of the leg portion 106.

From the foregoing and as mentioned above, it will be observed that numerous variations and modifications may be effected without departing from the spirit and scope of the novel concept of the invention. It is to be understood that no limitation with respect to the specific methods and apparatus illustrated herein is intended or should be inferred.

The invention claimed is:

1. A lighting assembly for attachment to a surface wherein a frame defined by said lighting assembly and to be secured to said surface includes a pair of channels on either side thereof, the assembly further comprising:

a diffuser having a body with a hollow interior and having a lip extending outwardly from a rim defined about the circumference of the body, and at least one clip having a body portion including first and second arms extending away from the body portion, the first arm having an intermediate curved segment that corresponds to an intermediate curved segment on the second arm to secure the clip to the rim of the diffuser, a rounded region formed on the main body portion to define a cavity between the main body portion and the first and second arms, the cavity sized to receive the lip of the diffuser, and a leg portion extending away from the rounded region and extending into the hollow interior of the diffuser, the leg portion of said clip further extending into the channel of the frame, whereby the diffuser is removably secured to the frame of said lighting assembly.

2. The lighting assembly of claim 1, wherein the diffuser includes a pair of ribs outwardly projecting from the lip and spaced to provide a region therebetween to accommodate a clip, wherein said clip when positioned within said pair of ribs is prevented from sliding along with rim of the diffuser.

3. The clip of claim 1, wherein the intermediate curved segments defined on the first and second arms of the clip are offset and inverted with respect to each other.

4. The clip of claim 3, wherein the offset and inverted curved segments defined on the first and second arms of the clip are positioned such that one of the curved segments on one of the arms includes an endpoint that lies between two endpoints defined by the corresponding curved segment on the other arm.

* * * * *